US005351919A

United States Patent [19]

Martin

[11] Patent Number: 5,351,919

[45] Date of Patent: Oct. 4, 1994

[54] TRAINLINE COMMUNICATION LINK USING RADIO FREQUENCY SIGNAL

[75] Inventor: André Martin, Brossard, Canada

[73] Assignee: Primetech Electroniques Inc., Dollard des Ormeaux, Canada

[21] Appl. No.: 38,010

[22] Filed: Mar. 29, 1993

[51] Int. Cl.[5] ..... B61L 23/00; G08C 19/00

[52] U.S. Cl. ..... 246/167 R; 246/187 C; 213/1.3; 340/870.11

[58] Field of Search ..... 246/166.1, 167 R, 169 R, 246/182 R, 187 C, 191; 213/1.3, 1.6; 340/870.11, 870.12; 364/424.01, 424.03, 424.05

[56] References Cited

U.S. PATENT DOCUMENTS

| | | | |
|---|---|---|---|
| 3,273,145 | 9/1966 | Joy et al. | 246/187 C |
| 3,696,758 | 10/1972 | Godinez, Jr. | 246/167 R X |
| 3,790,780 | 2/1974 | Helmcke et al. | 246/187 C |
| 3,868,909 | 3/1975 | Pelabon | 213/1.3 X |
| 3,994,459 | 11/1976 | Miller et al. . | |
| 4,041,470 | 8/1977 | Slane et al. | 246/169 R X |
| 4,582,280 | 4/1986 | Nichols et al. | 246/182 R |
| 4,682,144 | 7/1987 | Ochiai et al. . | |
| 4,723,737 | 2/1988 | Mimoun | 246/167 R X |
| 5,039,038 | 8/1991 | Nichols et al. | 246/187 C |
| 5,121,410 | 6/1992 | Desmarais . | |

*Primary Examiner*—Michael S. Huppert
*Assistant Examiner*—Scott L. Lowe
*Attorney, Agent, or Firm*—Chilton, Alix & Van Kirk

[57] ABSTRACT

The link permits communications between cars of a railway or subway trains. On at least a first one of the cars, a multiplexer multiplexes digital signals representative of the status of various systems on the car, and processes them into a first digital trainline signal. A transmitter includes a modulator which converts the digital trainline signal to a RF signal, and the RF signal is transmitted, by an antenna, through free space from the first car to a second car. The second car includes an antenna for receiving the RF signal, and a receiver for de-modulating the signal and converting it to a second digital trainline signal. A demultiplexer demultiplexes the second digital trainline signal into appropriate formats readable by the train systems on board the second car. Both the first and second cars include multiplexers and demultiplexers, and transmitters and receivers, so that communication is possible between the first car and the second car as well as between the second car and the first car.

1 Claim, 4 Drawing Sheets

TRAINLINE COMMUNICATION LINK USING RADIO FREQUENCY SIGNAL

BACKGROUND OF INVENTION

1. Field of the Invention

The invention relates to a novel communication link for permitting communications between cars of a multi-car vehicle such as railway or subway trains. More specifically, the invention relates to such a communication link which includes free space radio communications between adjacent cars of the railroad or subway train.

2. Description of the Prior Art

In order to adapt to changing system requirements, such as passenger or freight volume, routing, maintenance, crew or rolling stock availability, etc., rail cars are coupled and uncoupled frequently. Train configuration and reconfiguration in this sense represents a significant proportion of all train operation, whether considered in terms of rolling-stock-hours, man-hours, out-of-service hours, or whatever. Therefore, these processes must be made as simple and as automated as possible.

While it is true that trains are made up a variety of different types of cars, and in some cases, certain groups of cars are rarely uncoupled, it is nonetheless a fact that a great number of individual couplings and uncouplings are performed every day. An example of a present system is illustrated in U.S. Pat. No. 5,121,410, Demarais, Jun. 9, 1992. As can be seen in FIG. 4 and 5 of the '410 patent, communication lines between cars (car n−1, car n and car n+1) is effected by twisted pairs of wires.

This invention addresses the problem of how to provide adequate information transfer between cars without inhibiting train car coupling or uncoupling.

This invention proposes a solution which provides high-volume, high-reliability information transfer between cars.

Information transfer between devices installed on different cars, in the form of electrical signals, has been a common feature of trains for a number of years. The electrical pathway that carries these signals is called a "trainline". It is made up of a bundle of wires, each of which is connected in an electrically continuous path over the length of the train.

On board devices that use the trainline can interact with each other in a wide variety of ways. For example, a device on one car, such as a switch, may be used to control a number of similar devices, such as lights, on every car of the train. For another example, a specific type of sensor may be installed on every car. If certain conditions arise on one car, the sensor may need to activate a warning buzzer installed in the cab of the head car. Many other configurations are possible.

The changing trainline information transfer requirements brought on by advances in electronic technology over the past two decades have given rise to new problems for trainline designers. Two interrelated factors are at issue here: information volume and information reliability.

In general, the volume of information transferred between rail cars has increased over the period mentioned. It promises to continue to increase for some time to come, as train systems on board each car utilize more and more electronic and electrical equipment. This increased information flow may be addressed in two ways. The increased flow may be handled by an increasing number of wires, or else each wire must handle a larger volume of information.

Reliability of information transfer between cars is and always has been essential to safe, efficient train operation. Within each car, reliability is accomplished by providing mechanically secure conventional electrical connectors that are rarely opened. However, for communications between adjoining cars, the connecting elements on the adjoining cars must be automatically and frequently connected and disconnected, rendering conventional electrical connectors inefficient.

The use of such connecting elements cause many problems leading to a large percentage of subway service interruptions. Some of the problems are as follows:

1. Faulty electrical contact caused by pin oxidation.
2. Faulty electrical contact caused by dirt, grease and foreign matter on pins that accumulates when the pins are disconnected and therefore exposed.
3. Electrical contact is prevented when a pin fails to spring back out to its proper position due to accumulated dirt, grease and foreign matter inside the pin tube.
4. Electrical contact is prevented when returned springs fail due to loss of spring elasticity, which in turn is caused by de-tempering of the spring steel when abnormally high electrical current passes through the spring rather than the electrical shunt.

All of the above problems produce service interruptions and require expensive maintenance. Periodically, the pins must be checked and cleaned to ensure correct operation.

It is also known in the art to use optical arrangements to provide communication links between cars within a subset, and between the subsets of a train, as illustrated in U.S. Pat. No. 4,682,144, Ochiai et al, July 21, 1987. Such a system is illustrated in FIG. 4 of the '144 patent.

The problem with optical systems in the environment of either subway or railroad trains is that the systems are operating in very dirty environments so that the optical couplers will very shortly become dirty themselves. Due to the dirt which will accumulate on the optical couplers, optical transmission is degraded and possibly completely eliminated. Accordingly, the system as illustrated in the '144 patent is not a practical solution to the provision to communication links between the end cars of subsets of a train.

In U.S. Pat. No. 3,994,459, Miller et al, Nov. 30, 1976, a radio system is used to provide communications between a car which is derailed from a train and the remainder of the train. However, the '459 patent does not teach any other communications between the cars of the train using radio signals.

Another factor affecting reliability is the increase in information volume mentioned above. All else being equal, as information volume increases, overall reliability tends to decrease.

In summary, current train communications systems attempt to provide reliability by two methods: coupler pins and cable connectors. While the method of cable connectors between cars provides excellent reliability, it makes coupling and uncoupling the cars a laborious process. On the other hand, although coupler pins provide excellent ease of operation, they require high maintenance to maintain adequate reliability. Coupler pins are sensitive to environmental factors, and other problems. By far the highest incidence of communication failure, especially intermittent failure, occurs due to coupler pin problems.

Increasing the number of wires may work up to a point, but limitations are imposed on this method by a number of factors. Among the most serious of these factors is the problem of large numbers of electrical connections between cars that must be coupled and uncoupled frequently. These connections are at best a trade-off between reliability and automation; as their numbers increase, reliability and/or automation are reduced.

Increasing the volume of information handled by each wire eliminates the necessity of large numbers of electrical connections between cars. However, the high volume of information carried by each wire makes these connections vulnerable to both data loss and increased maintenance, due reliability problems associated with the current state of the art of high-volume information flow through coupler pins.

SUMMARY OF INVENTION

It is therefore an object of the invention to provide a communication link for communications between cars of a train which overcomes the disadvantages of the prior art.

It is a more specific object of the invention to provide such a novel communications link which comprises a radio link through free space.

It is a still more specific object of the invention to provide such a novel communications link which comprises a multiplexer and a demultiplexer on selected ones of the cars of the train.

In accordance with a particular embodiment of the invention there is provided a communication link for permitting communications between adjacent cars of a railway or subway trains, said link comprising:

on at least a first one of said cars, a multiplexing means for multiplexing digital signals representative of the status of various systems on said first one of said cars, and for processing said digital signals into a first digital trainline signal;

means for converting said first digital trainline signal to a radio frequency signal;

means for transmitting said radio frequency signal by free space radio communication from said first one of said cars to a second one of said cars;

said second one of said cars including means for receiving said radio frequency signal;

said second one of said cars also including means for converting said radio frequency signal to a second digital trainline signal;

said second one of said cars including a demultiplexer for demultiplexing the second digital trainline signal into appropriate formats readable by the train systems on board the second car.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
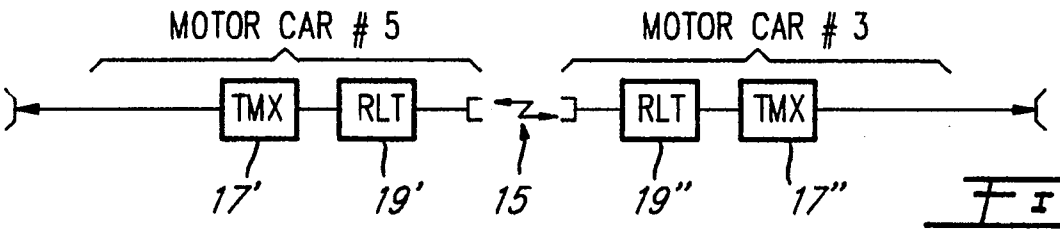
FIG. 1 is a schematic drawing illustrating two back-to-back cars of a train, the radio link between the cars, and the circuits linked by the radio links.

As seen in FIG. 1, a free space communication link 15 permits communications between cars 3 and 5. Each car includes a train line multiplexer (TMX) 17' and 17'' and a radio link transceiver (RLT) 19' and 19''.

Figure 2:
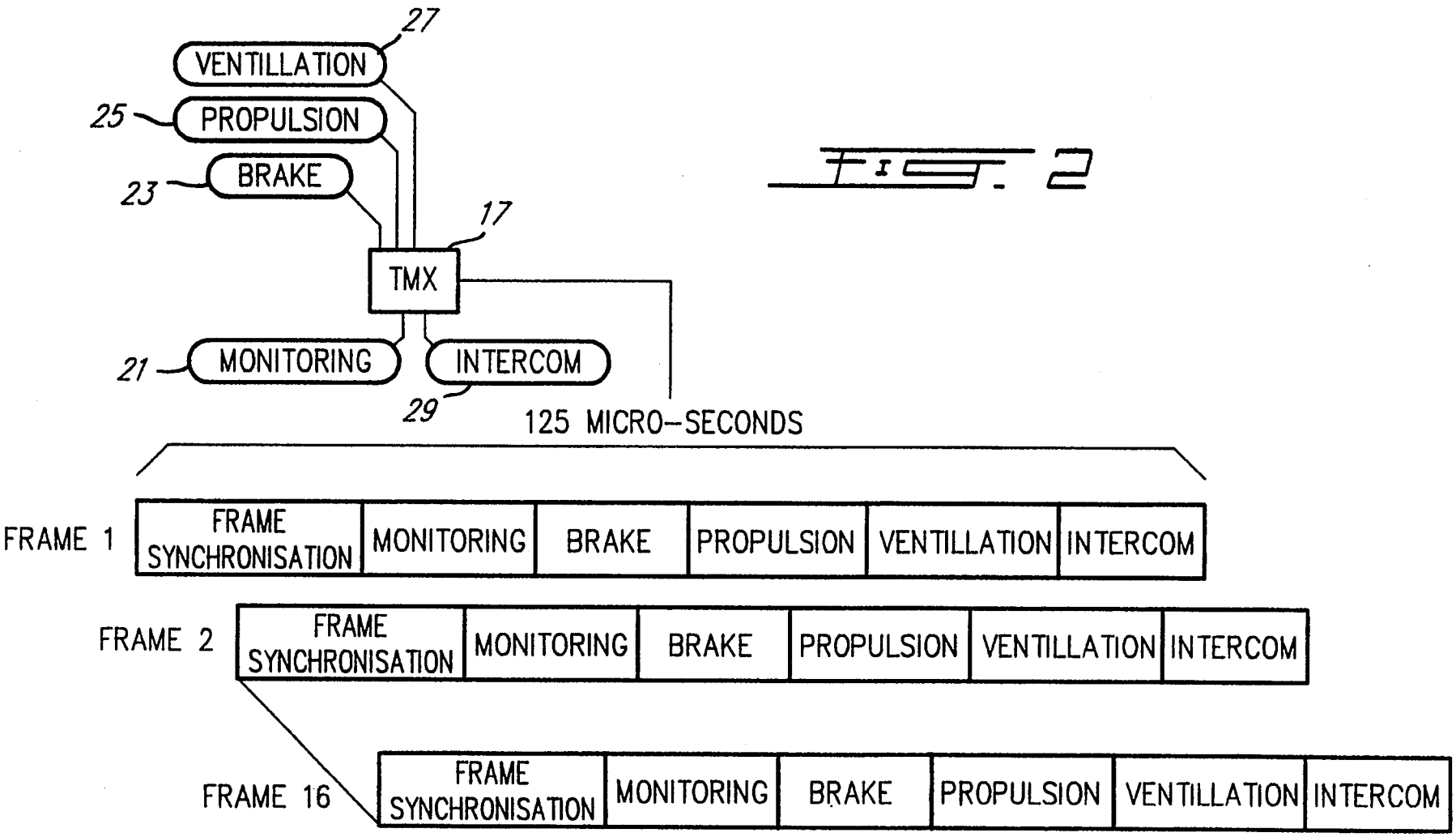
FIG. 2 illustrates in greater detail a Train Line Multiplexer (TMX)

As seen in FIG. 2, the multiplexer 17 will receive digital signals of samples from different train systems, for example, monitoring system 21, brake system 23, propulsion system 25, ventilation system 27 and intercom system 29. These signals are arranged in a predetermined order to form a frame which can be, for example, 125 microseconds long. As can be seen, each frame includes a frame synchronization signal at the beginning of the frame.

These signals are then passed to the transmitter which transmits them, via the communications link, to a different, usually adjacent, train car.

At the receiving end, the demultiplexer will provide the digital signals to the various trains systems, that is, the monitoring system 21, the brake system 23, the propulsion system 25, the ventilation system 27 and the intercom system 29. Multiplexing and demultiplexing systems are, of course, well known in the art so that no further description is required.

Figure 3A:
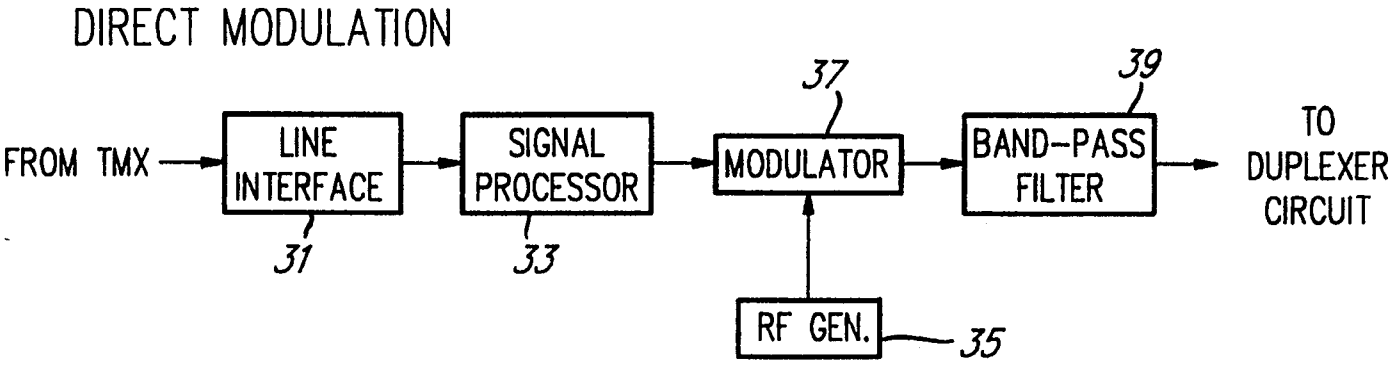
FIGS. 3A and 3B illustrate two modulation approaches for the transmitters of the radio link transceiver (RLT)
Figure 3B:
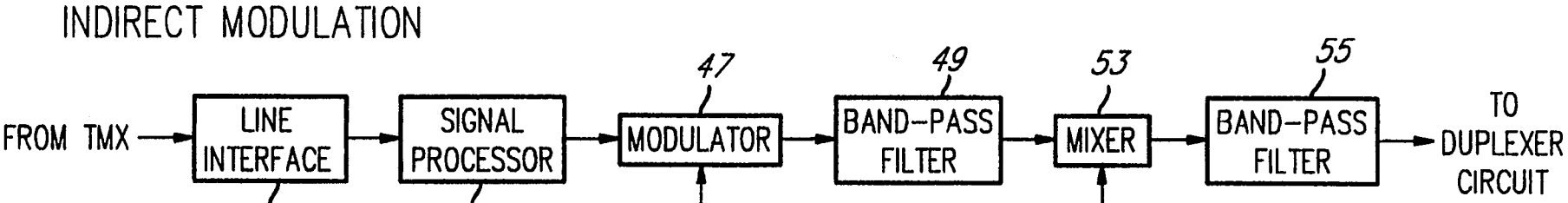

The output of the TMX is, as seen in FIGS. 3A and 3B, fed to the modulation unit of the RLT. FIG. 5A illustrates a direct modulation unit while FIG. 5B illustrates an indirect modulation unit. Each unit includes a line interface (31 or 41) and a signal processor (33 or 43). These units process the signals to put them into condition for use in the modulator. Thus, if there are a long string of zeros in the signals, then the signals must be modified to include ones and zeros, and such modification will take place in the units 31, 41 and 33, 43.

Referring now to FIG. 3A, the output of the signal processor 33 is fed to a modulator 37 which has a second input terminal fed by an RF generator 35. The output of the modulator is fed to a bandpass filter 39, and the output of the filter is fed to a duplexer circuit illustrated in FIG. 5.

Turning to FIG. 3B, the output of the signal processor 43 is once again fed to a modulator 47. However, in this case, the second terminal of modulator 47 is fed from IF source 45. The output of the modulator 47 is once again passed through a bandpass filter 49, the output of the filter 49 is fed to a mixer 53. The second input terminal of mixer 53 is fed from an RF generator 51, and the output of mixer 53 is fed to bandpass filter 55. The output of bandpass filter 55 is once again fed to the duplexer circuit.

Figure 4:
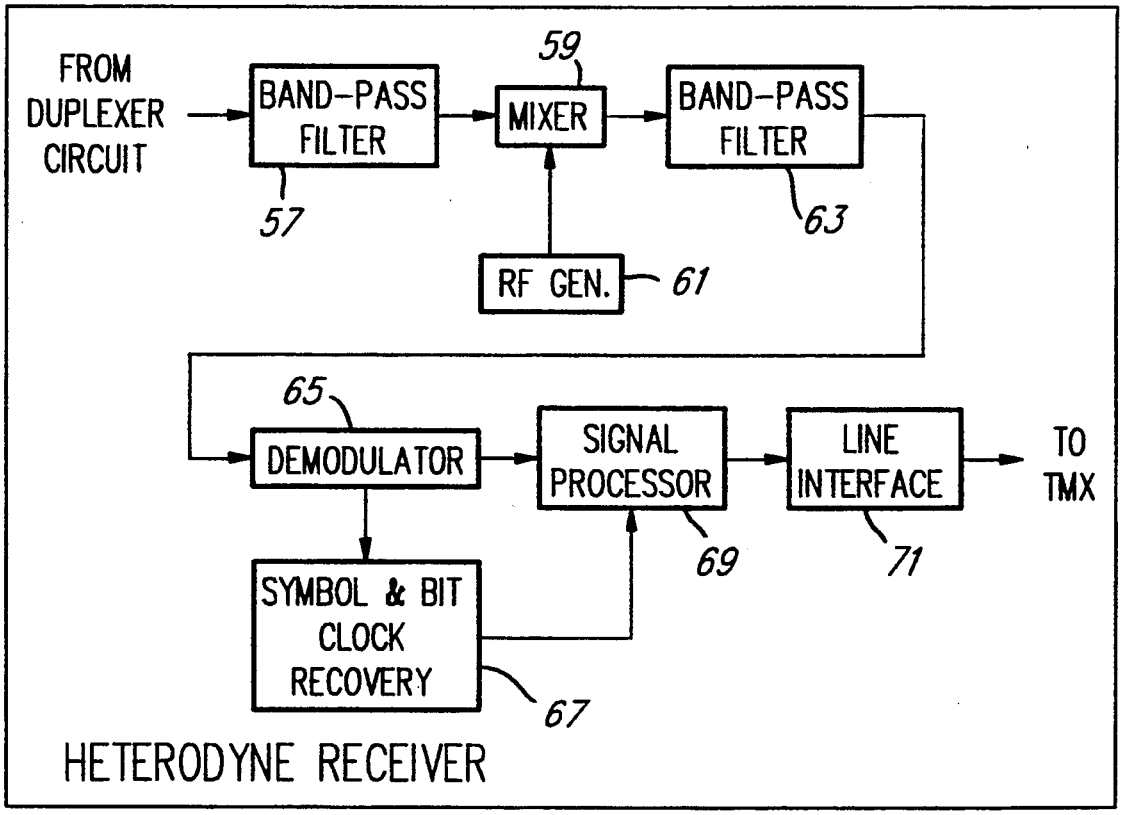
FIG. 4 illustrates a particular embodiment of the RLT receiver.

FIG. 4 illustrates one embodiment of the receiver portion of the RLT. The output of the duplexers circuit is fed to a bandpass filter 57 whose output is fed to a mixer 59. The received signal is then mixed with an RF signal from RF generator 61 applied to the second terminal of the mixer 59. The output of the mixer is fed to a bandpass filter 63 whose output is fed to a demodulator 65. The synchronization signal is fed from the demodulator 65 to symbol and bit clock recovery circuit 67, and the output of both 65 and 67 are fed to signal processor 69. The output of 69 is fed to line interface 71 whose output is then fed to the TMX.

Figure 5:
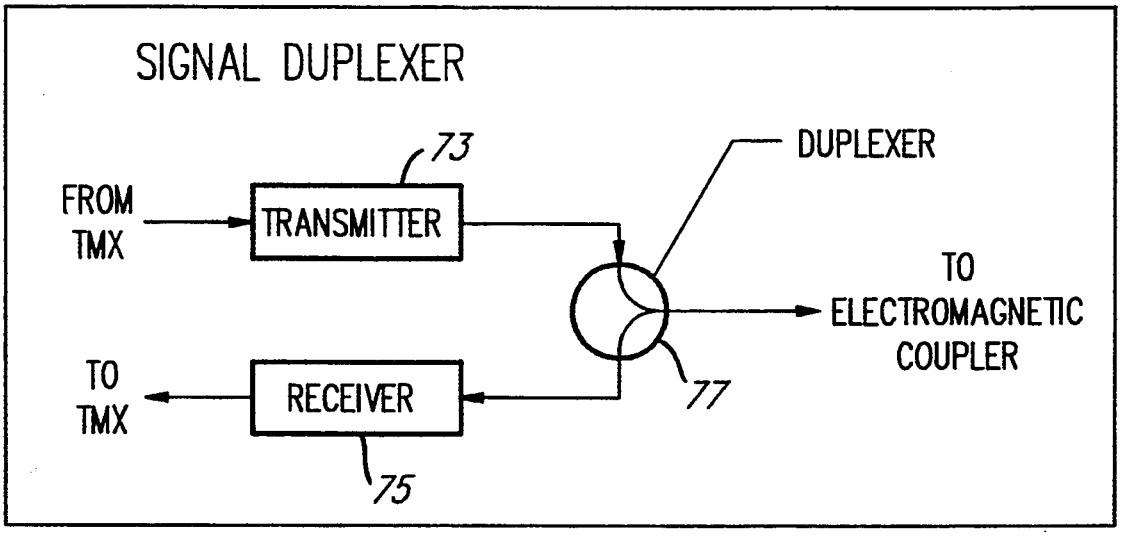
FIG. 5 illustrates a duplexer arrangement constituting a part of the RLT.

FIG. 5, which illustrates the duplexer 77, and the transmitter 73 and the receiver 75 is self-explanatory.

Figure 6:
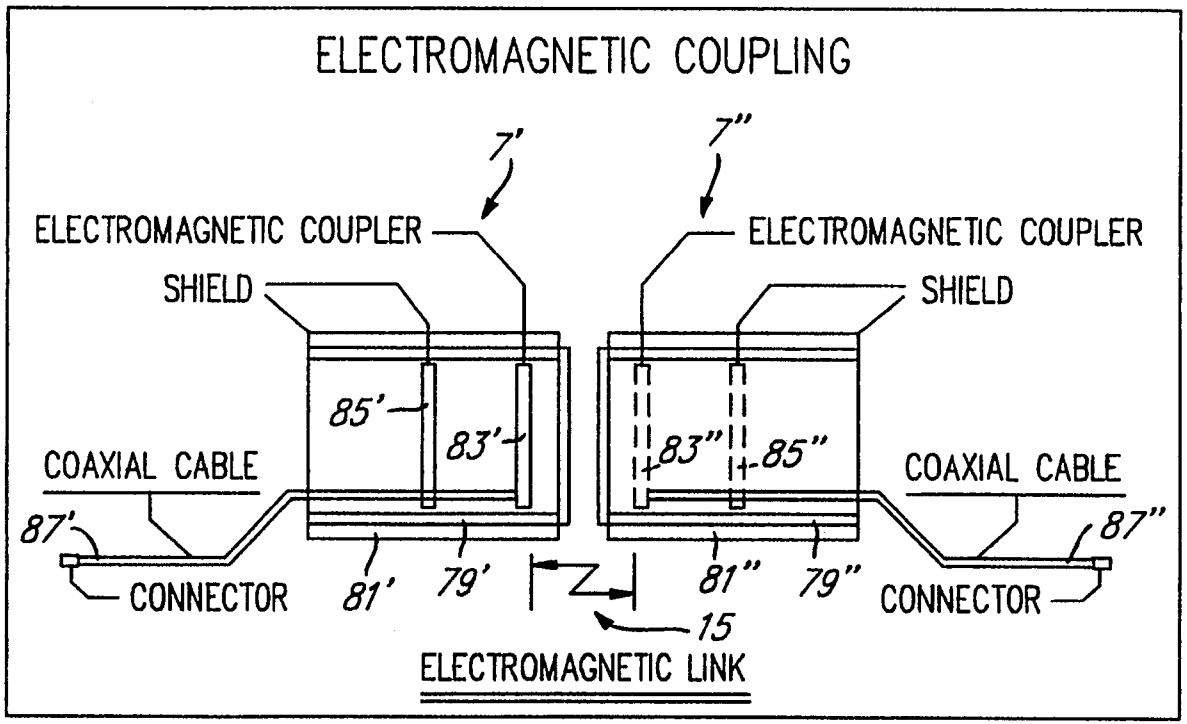
FIG. 6 illustrates in greater detail the radio link between the end cars.

Turning now to FIG. 6, the free space electromagnetic link 15 between car 7' and car 7" is effected by RF antennas 83' and 83" respectively. In a particular embodiment, the antennas are mounted in housings 79' and 79", respectively, which housings are made of a dielectric material, for example, polycarbonate material. Each housing comprises a sealed enclosure which protects the antenna from humidity and Water damage.

Disposed around the housing 79' and 79" are metallic shields 81' and 81". As can be seen, the shields do not extend across the front of the housings 79' and 79" (that is, the parts of the housings facing each other) but do extend around the antennas to prevent a spurious dispersion of the RF signals from the antennas 83' and 83" in any direction from one car to another car, and do not allow the antennas to pick up any spurious electromagnetic signals except those originating from the other end car.

The shields also include conductor elements 85 and 85" to prevent backward transmission or reception from the rear. Connector cables 87' and 87" connect the antennas to the RLT units of their respective cars.

The couplers are mounted on the exterior of the car and, when the cars are coupled to each other, are physically close to each other. They are sealed against water and humidity and protected from flying stones both by the housing 79' and 79" and the shields 81' and 81".

Although the housings illustrated in FIG. 6 would be necessary for a particular type of antenna, if the antennas are small enough, then they would not have to be protected by such a housing. In fact, in some situations, it might be possible to mount the housings inside of the cars. Accordingly, the housing is for a particular situation.

The present inventive arrangement is not subject to the physical disadvantages of the pin and spring arrangements, and they are not effected by the fact that they have to operate in a dirty environment.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A communication link for permitting communications between adjacent cars of a multi-car vehicle, said link comprising:

(A) on a first one of said cars, (i) a first multiplexing/demultiplexing means for multiplexing first digital signals representative of parameters associated with various systems on said first one of said cars and for processing said first digital signals into a first digital trainline signal;

(ii) first converting means for converting said first digital trainline signal to a first radio frequency signal;

(iii) a first antenna mounted on one end of said first one of said cars for transmitting said first radio frequency signal;

(B) on a second, adjacent one of said cars, (i) a second multiplexing/demultiplexing means for multiplexing second digital signals representative of parameters associated with various systems on said second one of said cars, and for processing said second digital signals into a second digital trainline signal;

(ii) second converting means for converting said second digital trainline signal to a second radio frequency signal;

(iii) a second antenna, mounted on an end of said second one of said card adjacent said one end of said first one of said cars, for transmitting said second radio frequency signal;

said second antenna receiving said first radio frequency signal and said second multiplexing/demultiplexing means converting said first radio frequency signal into a third digital trainline signal which is equivalent to said first digital trainline signal;

said first antenna receiving said second radio frequency signal and said first multiplexing/demultiplexing means converting said second radio frequency signal into a fourth digital trainline signal which is equivalent to said second digital trainline signal;

a first housing mounted on said first one of said cars, including a first shielding means for surrounding and shielding said first antenna;

a second housing mounted on said second one of said cars, including a second shielding means for surrounding and shielding said second antenna; and said first housing and said second housing each comprising an open end and each being mounted such that the open end of the first housing faces the open end of the second housing;

wherein communications can be sent from said first one of said cars to said second one of said cars and from said second one of said cars to said first one of said cars via said first and second antennae by free space radio frequency coupling.

* * * * *

UNITED STATES PATENT AND TRADEMARK OFFICE

CERTIFICATE OF CORRECTION

PATENT NO. : 5,351,919

DATED : October 4, 1994

INVENTOR(S) : Andre Martin

It is certified that error appears in the above-indentified patent and that said Letters Patent is hereby corrected as shown below:

On drawing sheet delete figure 5, to be replaced with the drawing sheet, as shown on the attached page.

Column 5, line 21, change "85" to -- 85' --;

Column 6, line 22, (Claim 1, line 28) change "card" to -- cars --;

Signed and Sealed this

Fourth Day of April, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,351,919

DATED : October 4, 1994

INVENTOR(S) : Andre Martin

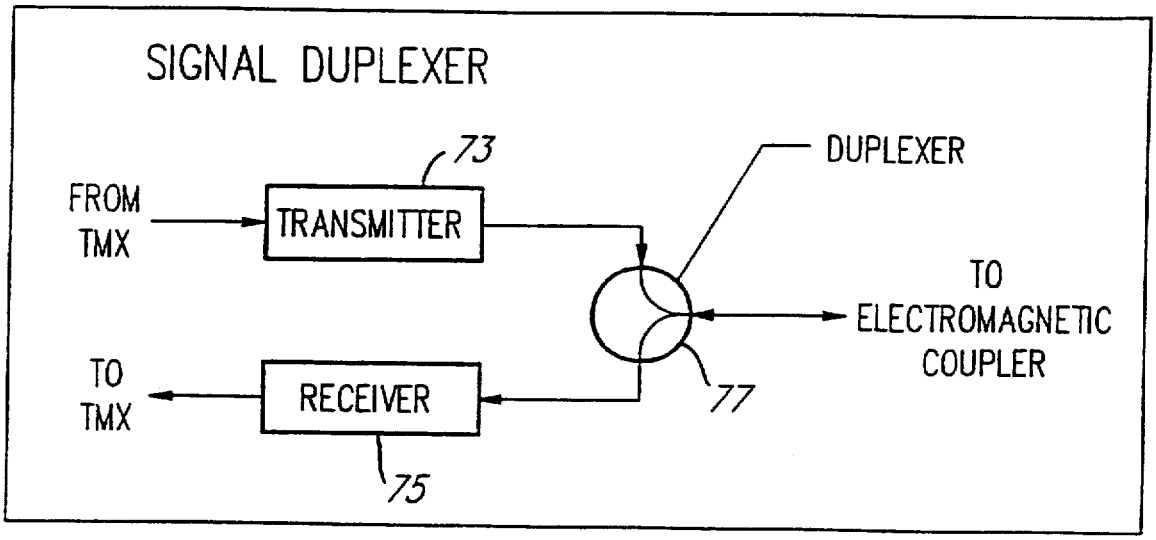

It is certified that error appears in the above-indentified patent and that said Letters Patent is hereby corrected as shown below: